US007997383B2

(12) United States Patent
Sakurai et al.

(10) Patent No.: US 7,997,383 B2
(45) Date of Patent: Aug. 16, 2011

(54) VEHICLE EXHAUST SYSTEM

(75) Inventors: Taisuke Sakurai, Shizuoka-ken (JP); Itsurou Hagiwara, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/692,783

(22) Filed: Mar. 28, 2007

(65) Prior Publication Data

US 2007/0227811 A1 Oct. 4, 2007

(30) Foreign Application Priority Data

Mar. 29, 2006 (JP) ..... 2006-092334
Feb. 9, 2007 (JP) ..... 2007-031098

(51) Int. Cl.

| | |
|---|---|
| ***F01N 1/02*** | (2006.01) |
| ***F01N 1/08*** | (2006.01) |
| ***F01N 1/10*** | (2006.01) |
| *F01N 1/00* | (2006.01) |
| *F01N 13/08* | (2010.01) |
| *F01N 13/00* | (2010.01) |

(52) U.S. Cl. ..... 181/252; 181/249; 181/256; 181/227

(58) Field of Classification Search ..... 181/249, 181/252, 255, 256, 227, 228; 180/309, 89.2, 180/296, 68.3

See application file for complete search history.

(56) References Cited

U.S. PATENT DOCUMENTS

| | | | | |
|---|---|---|---|---|
| 700,785 | A | 5/1902 | Kull | |
| 1,366,632 | A | 1/1921 | Bjarne | |
| 1,820,972 | A | 7/1929 | Haas | |
| 1,756,916 | A | 4/1930 | Stranahan | |
| 1,844,105 | A | 2/1932 | Schnell | |
| 1,853,429 | A | 4/1932 | Jackson | |
| 1,861,775 | A * | 6/1932 | Aseltine | 181/267 |
| 1,991,014 | A | 2/1935 | Compo | |
| 2,008,964 | A | 7/1935 | Mikulie | |
| 2,034,186 | A * | 3/1936 | Heath | 181/253 |
| 2,035,500 | A | 3/1936 | Nulty | |
| 2,041,767 | A * | 5/1936 | Jack | 181/248 |
| 2,065,343 | A | 12/1936 | Mitchell et al. | |
| 2,115,128 | A | 4/1938 | Starkweather et al. | |
| 2,150,530 | A | 3/1939 | Warsing | |

(Continued)

FOREIGN PATENT DOCUMENTS

DE 3724087 2/1989

(Continued)

OTHER PUBLICATIONS

European Search Report dated Jun. 20, 2007.

*Primary Examiner* — Edgardo San Martin

(74) *Attorney, Agent, or Firm* — Keating & Bennett, LLP

(57) ABSTRACT

An exhaust system for a straddle-type vehicle, such as a motorcycle, which achieves miniaturization and also provides a reduced noise output. The exhaust system is connectable to an engine of an associated vehicle and includes an exhaust pipe and a silencer. The silencer comprises an outer housing and an inner core accommodated in the outer housing. A sound absorbing material is arranged on an outer surface of a side wall of the inner core in a manner to come into close contact therewith. An air space is provided between an outer surface of the sound absorbing material and an inner surface of the outer housing.

20 Claims, 8 Drawing Sheets

U.S. PATENT DOCUMENTS

| | | | | | |
|---|---|---|---|---|---|
| 2,185,584 | A | * | 1/1940 | Boyce | 55/517 |
| 2,234,612 | A | | 3/1941 | Petersen | |
| 2,239,549 | A | | 4/1941 | Chipley | |
| 2,311,676 | A | * | 2/1943 | Maxim | 181/252 |
| 2,512,155 | A | | 6/1950 | Hill | |
| 2,523,260 | A | | 9/1950 | Campbell | |
| 2,543,461 | A | * | 2/1951 | Latulippe | 181/252 |
| 2,575,233 | A | | 11/1951 | Gustave | |
| 2,609,886 | A | | 9/1952 | Cline | |
| 2,640,557 | A | | 6/1953 | Gaffney | |
| 2,730,188 | A | | 1/1956 | Bailey | |
| 2,784,797 | A | | 3/1957 | Bailey | |
| 2,788,078 | A | | 4/1957 | Reindl | |
| 2,808,896 | A | * | 10/1957 | Wilman | 181/228 |
| 2,904,125 | A | * | 9/1959 | Bourne et al. | 181/248 |
| 3,109,511 | A | * | 11/1963 | Slayter et al. | 181/245 |
| 3,563,338 | A | * | 2/1971 | Rader | 181/243 |
| 3,710,891 | A | | 1/1973 | Flugger | |
| 3,786,791 | A | | 1/1974 | Richardson | |
| 3,955,643 | A | * | 5/1976 | Clark | 181/248 |
| 3,982,605 | A | | 9/1976 | Sneckenberger | |
| 4,108,275 | A | | 8/1978 | Black et al. | |
| 4,192,402 | A | | 3/1980 | Nakagawa et al. | |
| 4,360,076 | A | | 11/1982 | Suyama | |
| 4,371,053 | A | | 2/1983 | Jones | |
| 4,444,288 | A | * | 4/1984 | Sekiya et al. | 181/258 |
| 4,523,662 | A | * | 6/1985 | Tanaka et al. | 181/249 |
| 4,580,656 | A | * | 4/1986 | Fukuda | 181/252 |
| 4,589,517 | A | * | 5/1986 | Fukuda | 181/265 |
| 4,595,073 | A | * | 6/1986 | Thawani | 181/265 |
| 4,598,790 | A | | 7/1986 | Uesugi et al. | |
| 4,601,168 | A | | 7/1986 | Harris | |
| 4,674,594 | A | | 6/1987 | Jensen | |
| 4,700,805 | A | * | 10/1987 | Tanaka et al. | 181/265 |
| 5,107,953 | A | | 4/1992 | Shimizu et al. | |
| 5,350,888 | A | * | 9/1994 | Sager et al. | 181/247 |
| 5,365,025 | A | * | 11/1994 | Kraai et al. | 181/249 |
| 5,371,331 | A | | 12/1994 | Wall | |
| 5,509,947 | A | | 4/1996 | Burton | |
| 5,627,351 | A | * | 5/1997 | Okuma et al. | 181/231 |
| 5,633,482 | A | * | 5/1997 | Erion et al. | 181/282 |
| 5,661,272 | A | | 8/1997 | Iannetti | |
| 5,663,537 | A | | 9/1997 | Ko et al. | |
| 5,783,780 | A | * | 7/1998 | Watanabe et al. | 181/229 |
| 5,892,186 | A | * | 4/1999 | Flugger | 181/252 |
| 5,902,970 | A | | 5/1999 | Ferri | |
| 5,962,821 | A | | 10/1999 | Iannetti | |
| 5,969,299 | A | * | 10/1999 | Yamaguchi et al. | 181/227 |
| 6,026,930 | A | * | 2/2000 | Ogisu et al. | 181/228 |
| 6,070,695 | A | | 6/2000 | Ohtaka et al. | |
| 6,082,488 | A | * | 7/2000 | Lin | 181/256 |
| 6,260,659 | B1 | | 7/2001 | Takahashi et al. | |
| 6,467,572 | B1 | | 10/2002 | Liu | |
| 6,520,285 | B2 | * | 2/2003 | Tobias | 181/241 |
| 6,571,910 | B2 | | 6/2003 | Storm | |
| 6,739,426 | B2 | * | 5/2004 | Sherikar et al. | 181/248 |
| 6,745,562 | B2 | | 6/2004 | Berriman et al. | |
| 6,968,922 | B2 | * | 11/2005 | Kawamata et al. | 181/231 |
| 7,374,016 | B2 | * | 5/2008 | Yamaguchi et al. | 181/249 |
| 7,464,787 | B2 | * | 12/2008 | Davis, Jr. | 181/227 |
| 2002/0134614 | A1 | | 9/2002 | Chen | |
| 2003/0136607 | A1 | * | 7/2003 | Kawamata et al. | 181/231 |
| 2006/0219476 | A1 | | 10/2006 | Southway et al. | |

FOREIGN PATENT DOCUMENTS

| | | | | |
|---|---|---|---|---|
| DE | 40 06 438 | A1 | | 9/1990 |
| FR | 1 347 893 | A | | 1/1964 |
| FR | 2668539 | A1 | * | 4/1992 |
| FR | 2681905 | A1 | * | 4/1993 |
| GB | 2 041 083 | A | | 9/1980 |
| GB | 2 110 298 | A | | 10/1982 |
| GB | 2 158 878 | A | | 11/1985 |
| JP | 53 147142 | A | | 12/1978 |
| JP | 54028952 | A | * | 3/1979 |
| JP | 62082213 | A | * | 4/1987 |
| JP | 62243913 | A | * | 10/1987 |
| JP | 63 001714 | A | | 1/1988 |
| JP | 63001713 | | | 1/1988 |
| JP | 01 069709 | A | | 3/1989 |
| JP | 03264716 | | | 11/1991 |
| JP | 04081507 | | | 3/1992 |
| JP | 05026025 | | | 2/1993 |
| JP | 05280323 | | | 10/1993 |
| JP | 06117242 | | | 4/1994 |
| JP | 08-312324 | | | 11/1996 |
| JP | 08-312324 | A | | 11/1996 |
| JP | 2003-184541 | | | 7/2003 |
| JP | 2008138608 | A | * | 6/2008 |

* cited by examiner

[Fig. 1]
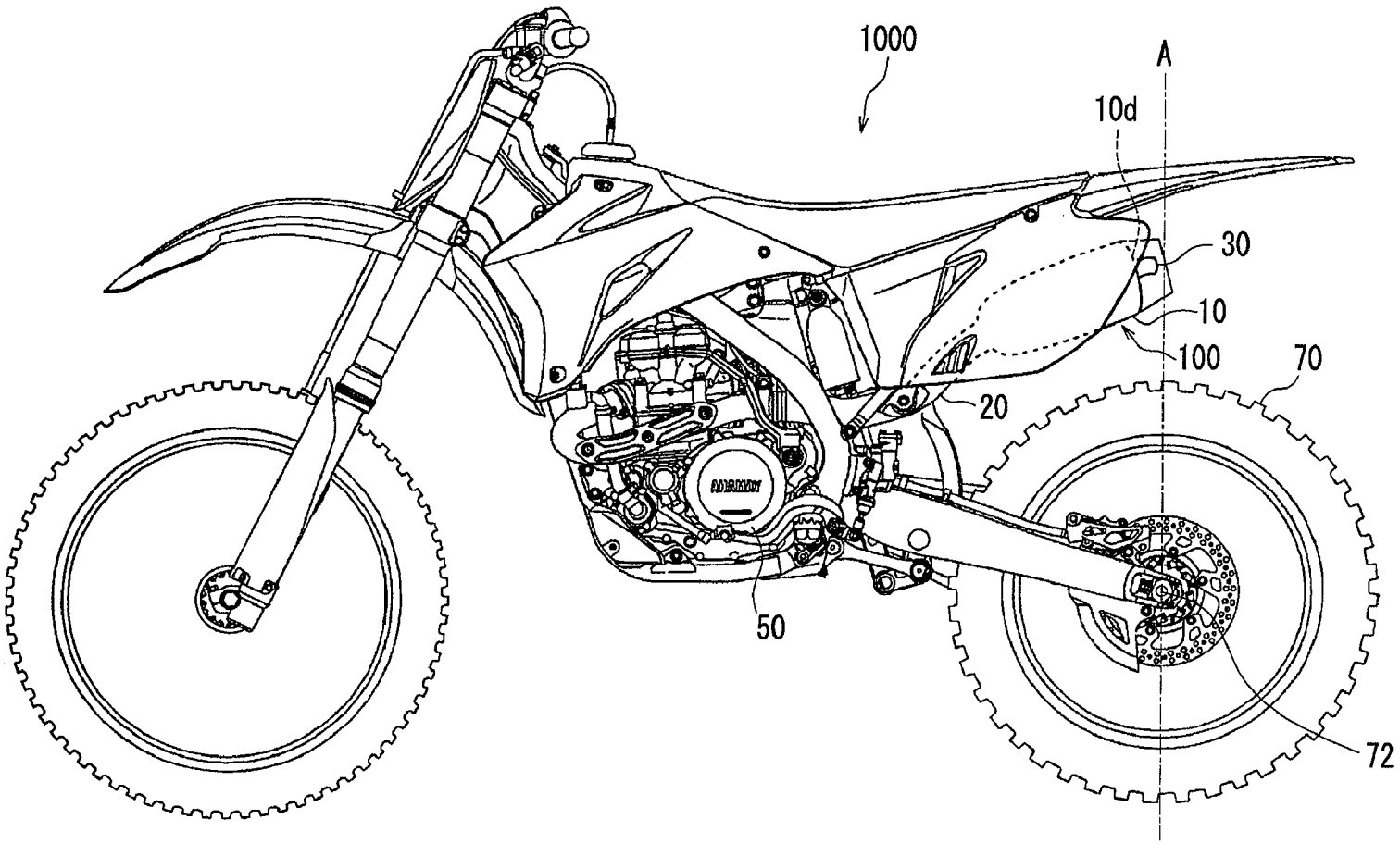

[Fig. 2]
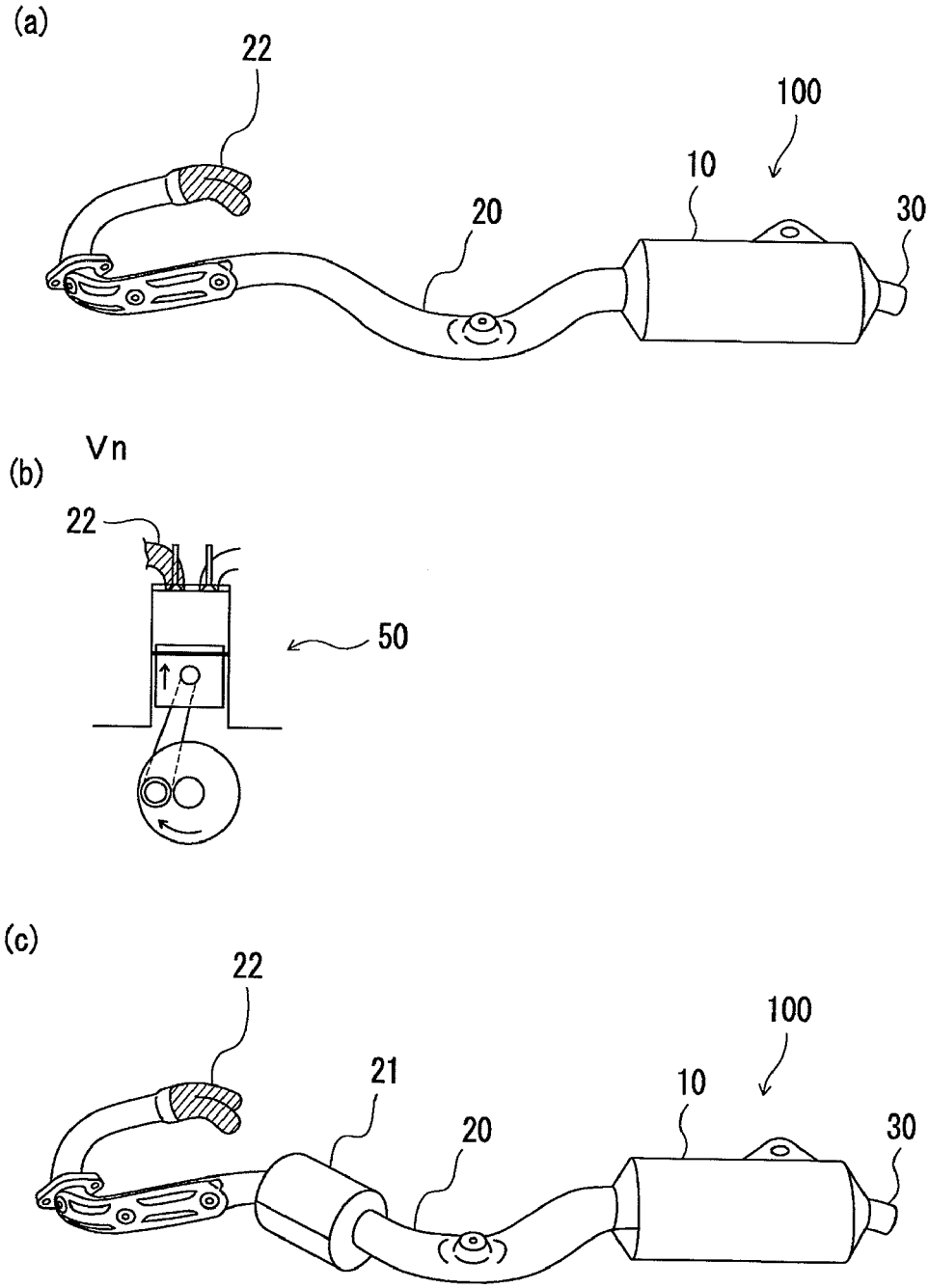

[Fig. 3]
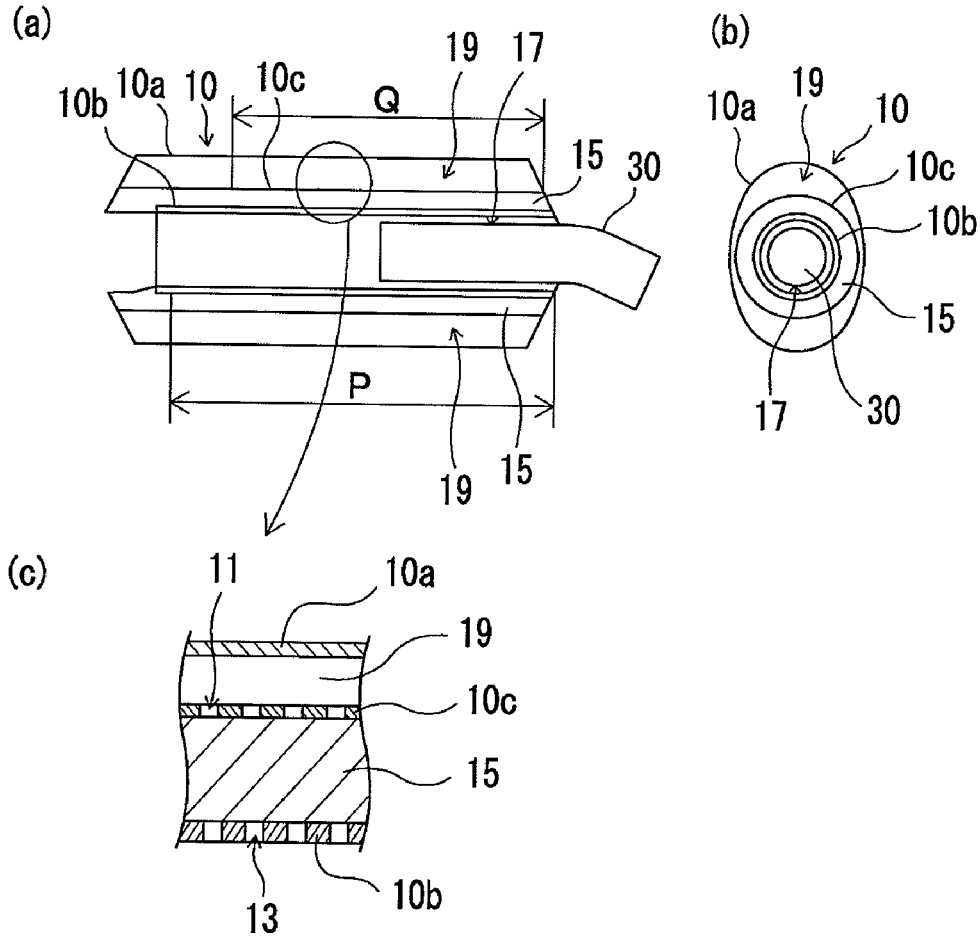

[Fig. 4]
(a)
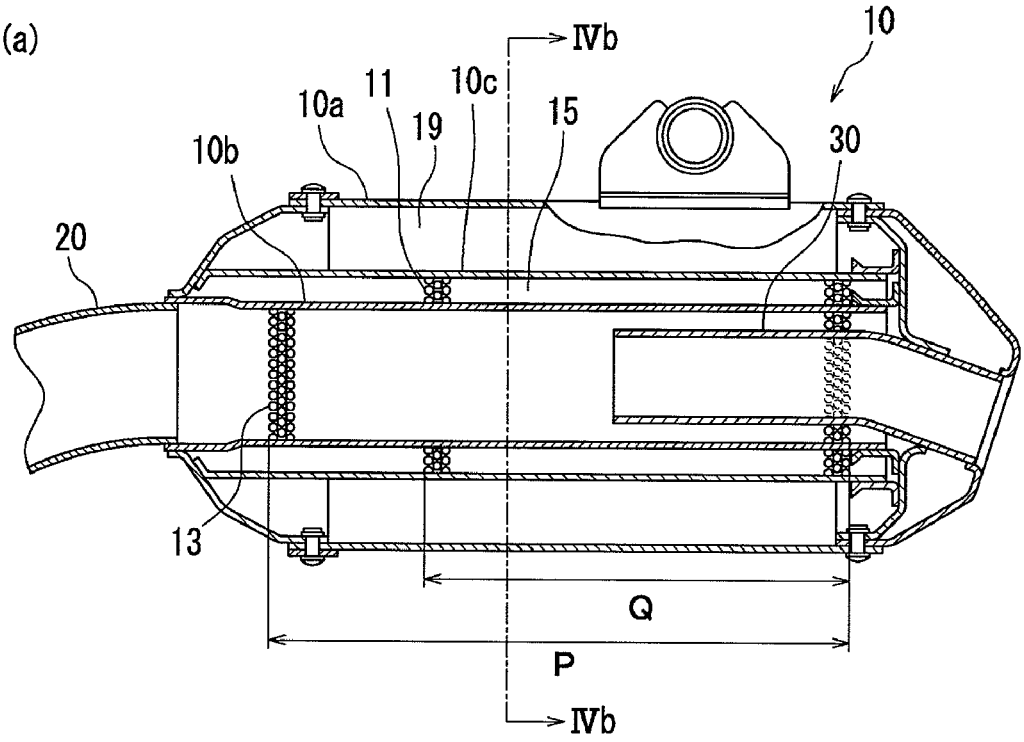
(b)
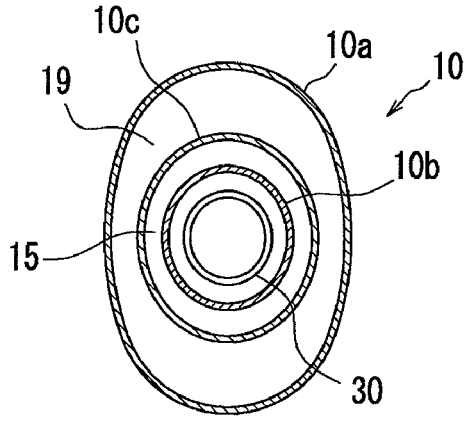

[Fig. 5]
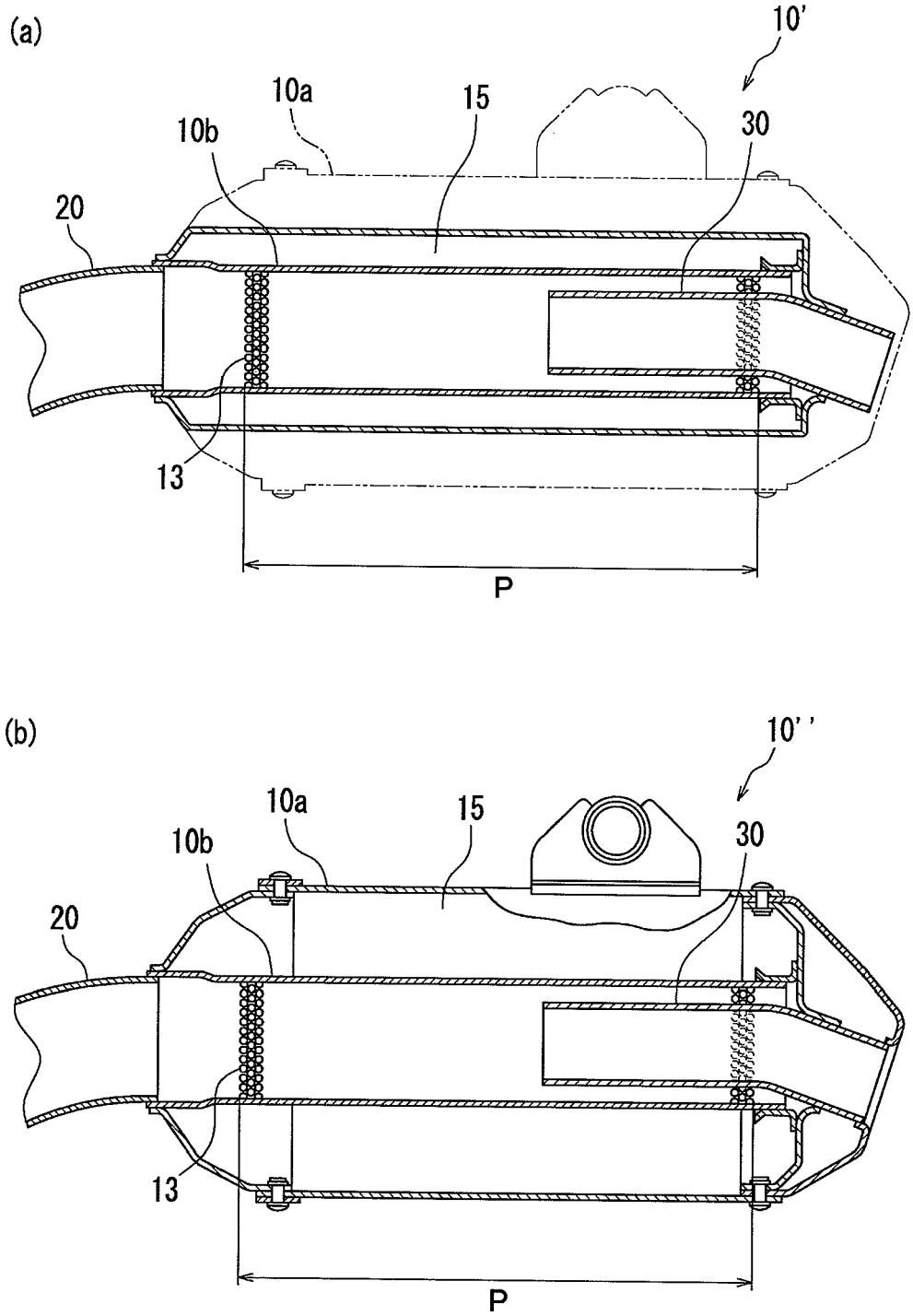

[Fig. 6]
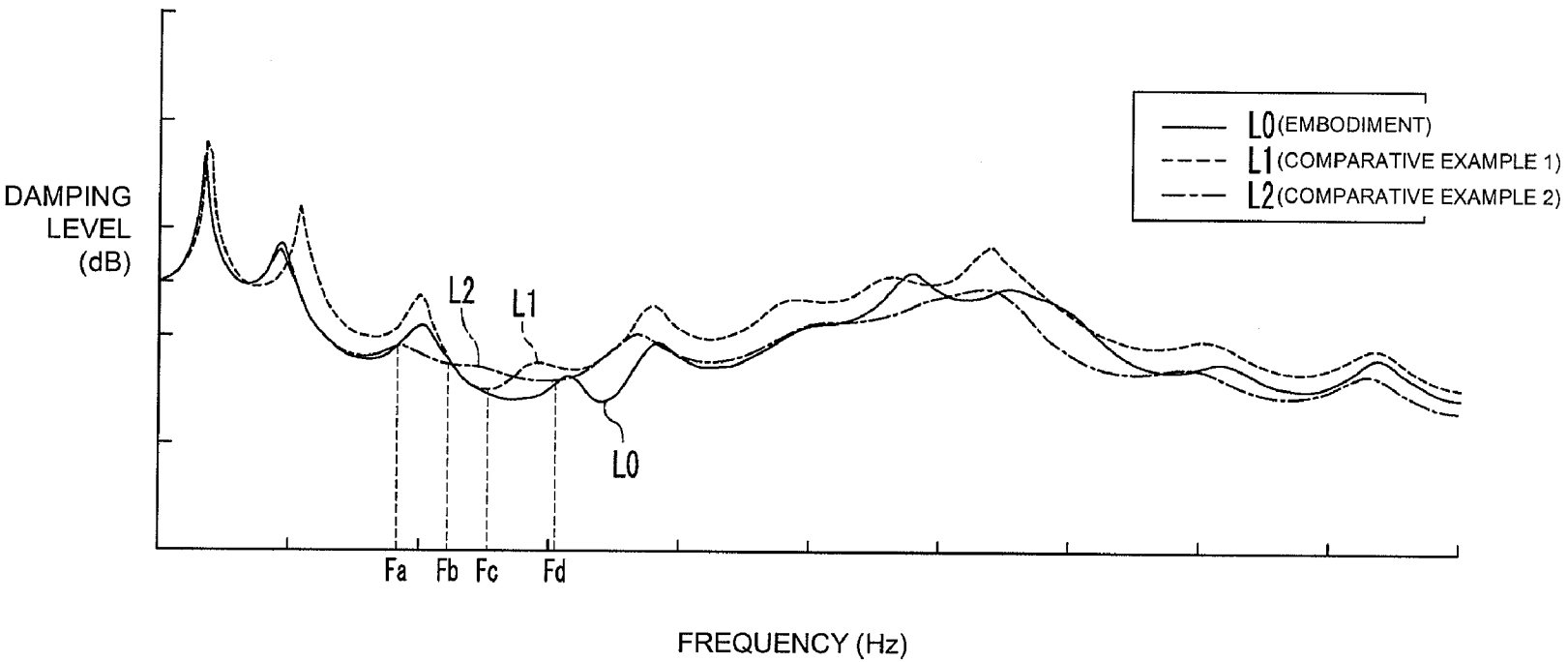

[Fig. 7]
(a)
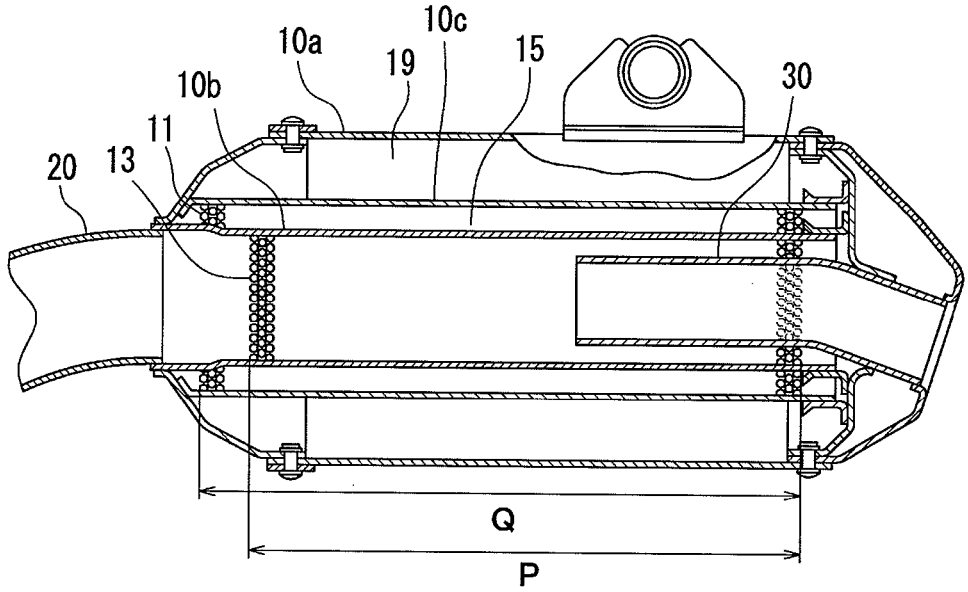
(b)
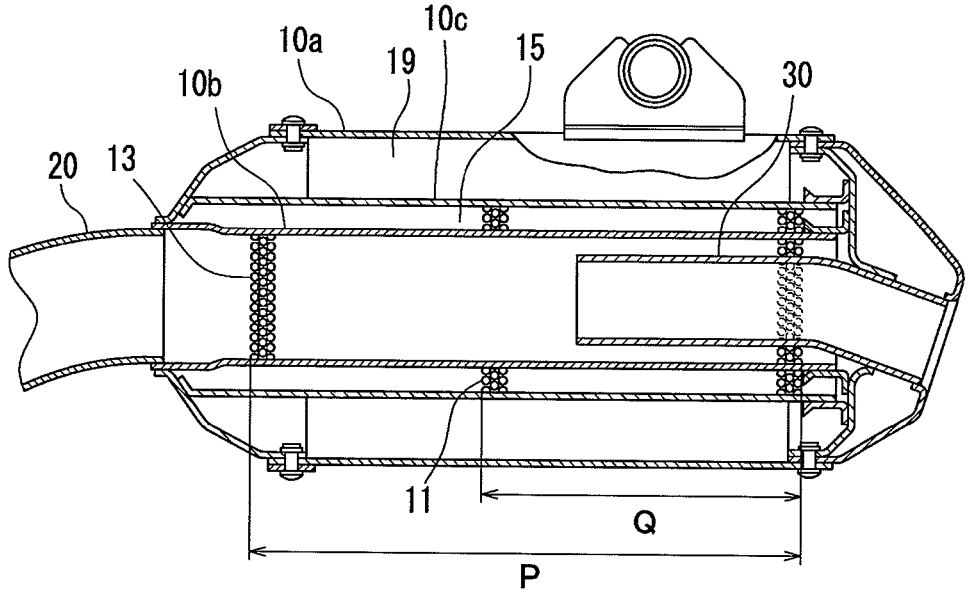

[Fig. 8]
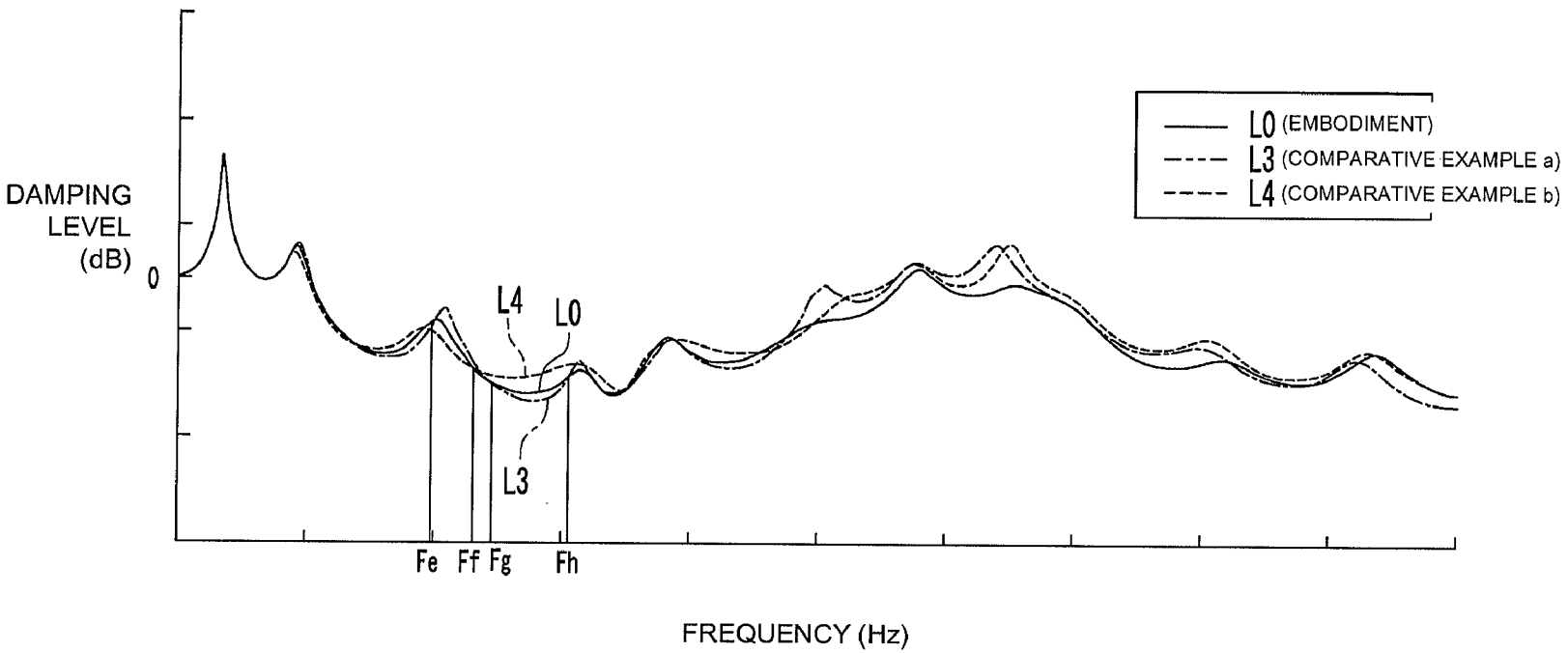

VEHICLE EXHAUST SYSTEM

RELATED APPLICATIONS

This application is related to, and claims priority from, Japanese Patent Application No. 2007-031098, filed Feb. 9, 2007 and Japanese Patent Application No. 2006-092334, filed Mar. 29, 2006, the entireties of which are hereby incorporated by reference herein and made a part of the present specification. Application Ser. Nos. 11/692,824; 11/692,808; and 11/692,814, entitled VEHICLE EXHAUST SYSTEM, all filed on Mar. 28, 2007, are also incorporated by reference herein in their entireties and made a part of the present specification.

BACKGROUND OF THE INVENTION

1. Field of the Invention

The present invention generally relates to an exhaust system for a vehicle. More particularly, the present invention relates to an exhaust system for a straddle-type vehicle and a straddle-type vehicle incorporating such an exhaust system.

2. Description of the Related Art

An exhaust system used in a straddle-type vehicle (for example, a motorcycle) is requested to meet two demands, that is, an exhaust efficiency, at which exhaust gases discharged from an engine should be efficiently discharged, and reduction of exhaust noise, which accompanies discharge of exhaust gases of high pressure and high temperature.

In particular, the demand for noise reduction or noise elimination has increased as noise regulations have been made more rigorous. Accordingly, it is increasingly desired that noise reduction or noise elimination be attained, while at the same time maintaining exhaust efficiency at desirable levels for performance reasons.

SUMMARY OF THE INVENTION

When design of an exhaust system is considered only in terms of exhaust efficiency, a muffler (exhaust system) is preferably extended straight. However, such an exhaust system is not well accommodated in a vehicle body of a motorcycle. Accordingly, in order to lessen an exhaust resistance, the exhaust system is extended toward the rear of a vehicle body in an attempt to avoid tight radius bends, which is difficult in many cases because of the front wheel of the motorcycle and a bank angle of the combustion chamber(s). Normally, a muffler having an ideal length in terms of engine performance is only seldom accommodated intact in a configuration of a motorcycle and, as compared with design of a muffler for four-wheel passenger cars, the design of a motorcycle exhaust system to meet both performance and physical constraints is significantly more challenging. That is, it is difficult in the context of a motorcycle exhaust system to achieve a length of the exhaust system that will both provide desired performance attributes and be accommodated within the space constraints of a motorcycle while maintaining a configuration that is as smooth as possible.

Also, not only an exhaust efficiency, but also a weight of a an exhaust system has a significant influence on the handling characteristics of a motorcycle. That is, because a motorcycle is relatively lightweight, even a weight of about one (1) kg has a great influence on the motorcycle. Moreover, because certain components of the exhaust system (e.g., the silencer) are usually located at a distance from a center of gravity of the motorcycle, the adverse influence of excess weight of the exhaust system on the handling characteristics of the motorcycle is increased.

On the other hand, in spite of any contrivance on a construction of the exhaust system, a certain silencer (or muffler) volume is needed to some extent to provide a noise reducing effect. In order to conform to regulations on noise, which are made increasingly rigorous, a silencer cannot but be made larger in many cases. Moreover, when a metallic sheet from which the silencer is constructed is thin, it vibrates thereby increasing noise. To avoid such a situation, the silencer is by all means liable to be relatively large in weight. An increase in the weight of the silencer results in undesired handling characteristics of the associated motorcycle.

In this manner, since a structure of an exhaust system for motorcycles is determined in terms of a variety of interrelated factors, it has been extremely difficult to realize an exhaust system in which miniaturization is achieved and a desired exhaust efficiency and noise-reduction characteristics are met.

Preferred embodiments of the present invention involve an exhaust system for a straddle-type vehicle, which includes an engine. The exhaust system includes an exhaust pipe connectable to the engine and a silencer connected to the exhaust pipe. The silencer comprises an outer housing and an inner core accommodated in the outer housing. A sound absorbing material is arranged in a manner to come into close contact with an outer surface of the inner core in the silencer. An air space is provided between an outer surface of the sound absorbing material and an inner surface of the outer housing.

A preferred embodiment involves an exhaust system as described above, in which a partition is provided on the outer surface of the sound absorbing material to separate the sound absorbing material and the air space. A plurality of through-holes is formed in at least a portion of the partition.

A preferred embodiment involves an exhaust system as described above, in which a plurality of through-holes is formed in at least a portion of the inner core of the silencer.

A preferred embodiment involves an exhaust system as described above, in which the sound absorbing material comprises one or more of stainless steel wool and glass wool.

A preferred embodiment involves a straddle-type vehicle provided with the exhaust system as described in any of the above paragraphs.

A preferred embodiment involves a straddle-type vehicle as described above, in which a downstream end of the inner core of the silencer is positioned forward of an axis of the axle shaft of a rear wheel provided on the straddle-type vehicle.

A preferred embodiment involves a straddle-type vehicle as described above, wherein the engine of the straddle-type vehicle operates on a four-stroke combustion principle.

A preferred embodiment involves a straddle-type vehicle as described above, wherein the straddle-type vehicle is an off-road motorcycle.

According to one or more embodiments of the invention, because the silencer comprises an outer housing and an inner core accommodated in the outer housing, and a sound absorbing material is arranged in a manner to come into close contact with an outer surface of the inner core, exhaust noise of exhaust gases introduced into the silencer can be absorbed by the sound absorbing material whereby it is possible to reduce the exhaust noise. Moreover, because an air space is provided between an outer surface of the sound absorbing material and an inner surface of the outer housing, exhaust gases can be expanded into the air space whereby it is possible to produce a noise reducing effect. That is, with the exhaust system according to certain preferred embodiments of the invention, it is possible to improve a damping characteristic of the muffler owing to both effects of noise reduction by the sound absorbing material and noise reduction by an expansion chamber effect.

BRIEF DESCRIPTION OF THE DRAWINGS

These and other features, aspects and advantages of the present invention are described below with reference to drawings of preferred embodiments, which are intended to illustrate, but not to limit the present invention. The drawings contain eight (8) figures.

FIG. 1 is a side view of a motorcycle including an exhaust system having certain features, aspects and advantages of the present invention.

FIG. 2(*a*) is a perspective view showing the exhaust system of the motorcycle of FIG. 1. FIG. 2(*b*) is a schematic view of an engine of the motorcycle of FIG. 1. FIG. 2(*c*) is a perspective view showing a modification of the exhaust system of FIG. 2*a*, in which the exhaust system includes an expansion chamber.

FIGS. 3(*a*) to 3(*c*) are schematic cross sectional views showing examples of a silencer of the exhaust system according to an embodiment of the invention.

FIGS. 4(*a*) and 4(*b*) are schematic cross sectional views of the silencer shown in FIG. 3.

FIGS. 5(*a*) and 5(*b*) are schematic cross sectional views of an exhaust system of a comparative example of an internal structure of a silencer.

FIG. 6 is a graph illustrating a comparison between a damping characteristic of the exhaust system according to a preferred embodiment and damping characteristics of mufflers of the comparative examples of FIGS. 5(*a*) and 5(*b*).

FIGS. 7(*a*) and 7(*b*) are schematic cross sectional views of an exhaust system according to another embodiment of the invention.

FIG. 8 is a graph illustrating a comparison in damping characteristic between the exhaust system of FIG. 4 and the exhaust systems shown in FIGS. 7(*a*) and 7(*b*).

DETAILED DESCRIPTION OF THE PREFERRED EMBODIMENT

While an exhaust system for a motorcycle is designed under various restrictions, conventional design philosophy is that a noise reducing effect cannot be actually produced unless the silencer is increased in volume. On the other hand, it is not possible to avoid a phenomenon in which an increase in volume of the silencer brings about an adverse affect on the handling characteristics of the motorcycle. In a muffler in, for example, present four-stroke motocross motorcycles (in particular, sports vehicles), a silencer is increased in volume whereby noise reduction and running performance are met, so that the muffler is large and heavy.

The present inventors have realize an exhaust device (muffler), which is small-sized and light while meeting performance criteria (exhaust property) and a noise characteristics. Embodiments of the invention are described below with reference to the drawings. In addition, the invention is not limited to the following embodiment.

FIG. 1 illustrates a motorcycle 1000, on which an exhaust system according to an embodiment of the invention is mounted. The exhaust system communicates with an engine 50 of the motorcycle 1000. The exhaust system 100 includes an exhaust pipe 20 and a silencer 10. In addition, the exhaust system 100 including the silencer 10 is in some cases referred to as "muffler" in the specification of the present application for the sake of convenience.

The muffler 100 according to the embodiment includes the exhaust pipe 20 connected to the engine 50 of the motorcycle 1000, and the silencer 10 connected to the exhaust pipe 20. With a construction shown in FIG. 1, a tail pipe 30 is connected to the silencer 10.

A state, in which the muffler 100 is removed from the motorcycle 1000 for convenience, is shown in FIG. 2(*a*). The exhaust pipe 20 and the silencer 10 of the muffler 100 shown in FIG. 2(*a*) are formed with members for mounting to a vehicle body. The muffler 100 is one for four-stroke engines and the motorcycle 1000 shown in FIG. 1 is an off-road vehicle. In addition, with the exhaust pipe 20 shown in FIG. 2(*a*), its end connected to the engine 50 mounts to a cylinder head exhaust port 22 of the engine 50.

The exhaust pipe 20 connects to an exhaust opening of the engine 50 as shown in FIG. 2(*b*) to lead exhaust gases from the engine 50 to the silencer 10. In the example as shown, the cylinder head exhaust port 22 of the exhaust pipe 20 is connected to the engine 50. The silencer 10 has a noise reducing function to discharge exhaust gases led from the exhaust pipe 20 to the external environment. In the case where the tail pipe 30 is connected to the silencer 10, exhaust gases are discharged from the tail pipe 30. In addition, as shown in FIG. 2(*c*), an expansion chamber 21 can be further provided in the exhaust pipe 20. In this case, exhaust gases from the engine 50 pass through the chamber 21 and are then led to the silencer 10 to be discharged to the external environment.

FIGS. 3(*a*) to 3(*c*) are cross sectional views schematically showing a structure of the silencer 10, into which exhaust gases are introduced. The silencer 10 includes an outer housing, or cylinder 10*a*, and an inner core, or cylinder 10*b*, accommodated in the outer cylinder 10*a*. Although referred to herein as "cylinders," the outer housing 10*a* and inner core 10*b* are not necessarily limited to circular cross-sectional shapes. The term "cylinder" is intended to be a broad term that includes any closed extrusion, including those having oval, rectangular and other non-circular or even varying cross-sectional shapes. The tail pipe 30 is connected to the silencer 10 to lead exhaust gases to the external environment.

A plurality of through-holes, or punched holes 13, is formed in at least a portion (region P) of the side wall of the inner cylinder 10*b* of the silencer 10. The punched holes 13 are small holes (through-holes) formed in the silencer 10 (here, the inner cylinder 10*b*). The punched holes 13 serve to lead exhaust gases to a sound absorbing material 15 arranged on the outer wall of the inner cylinder 10*b*. Although referred to herein as "punched holes," the holes 13 can be formed by any suitable process or method. Also, the punched holes 13 can be appropriately adjusted in diameter to have a magnitude such that the inner cylinder 10*b* can maintain a sound absorbing material holding function and efficiently transmit energy to the sound absorbing material.

In an example shown in FIG. 3, a sound absorbing material 15 is arranged between an inner surface of the outer cylinder 10*a* and an outer surface of the inner cylinder 10*b* in the silencer 10. More specifically, the sound absorbing material 15 is filled in a manner to come into close contact with the outer surface of the inner cylinder 10*b*. The sound absorbing material 15 comprises a material (for example, a porous material) capable of absorbing sound waves, and glass wool is used as the sound absorbing material 15 in this example.

The sound absorbing material 15 in the embodiment is not fully filled between the outer cylinder 10*a* and the inner cylinder 10*b*, but arranged offset toward the inner cylinder

10*b*. In other words, an air space, or air layer 19 (referred below to as "back air layer 19"), is provided between an outer surface of the sound absorbing material 15 and the inner surface of the outer cylinder 10*a*.

Further, a partition 10*c* is provided as a member that provides a partition between the sound absorbing material 15 and the back air layer 19. The partition 10*c* comprises a generally cylindrical-shaped member made of stainless steel and arranged on the outer surface of the sound absorbing material 15. Similar to the housing 10*a* and core 10*b*, the partition 10*c* may have a cross-sectional shape other than circular. Punched holes 11 are formed in at least a part (region Q) of the partition 10*c*. The punched holes 11 in the embodiment are small holes (through-holes) and can use the same structure as that of the punched holes 13 formed on the inner cylinder 10*b*. The partition 10*c* serves to lead exhaust gases, noise of which is reduced by the sound absorbing material 15, to the back air layer 19 through the punched holes 11 to expand the same.

With the exhaust device 100, the silencer 10 comprises the outer cylinder 10*a* and the inner cylinder 10*b* accommodated in the outer cylinder 10*a* and the sound absorbing material 15 is arranged in a manner to come into close contact with the outer wall of the inner cylinder 10*b*, exhaust noise of exhaust gases led from the exhaust pipe 20 can be absorbed by the sound absorbing material 15 to be reduced (noise reducing effect).

Furthermore, because the back air layer 19, which is separated from the sound absorbing material 15 by the partition 10*c* with the punched holes 11, is provided between the outer surface of the sound absorbing material 15 and the inner surface of the outer cylinder 10*a*, exhaust gases, noise of which is reduced by the sound absorbing material 15, can be expanded into the back air layer 19 through the punched holes 11 of the partition 10*c*, thus producing a noise reducing effect.

That is, with the illustrated exhaust device 100, it is possible to improve a damping characteristic of the muffler 100 owing to both effects of noise reduction by the sound absorbing material 15 and noise reduction by pipe bulging, in other words, an expansion chamber effect.

In addition, the muffler structure provided with the sound absorbing material 15 and the back air layer 19 can be preferably used in a small-sized muffler, in which miniaturization and reduced weight are achieved. "Small-sized muffler" referred to herein is the muffler 100 having a straight pipe structure positioned in front of an axis of an axle shaft 72 of a rear wheel 70 of the motorcycle 1000 shown in FIG. 1. In this example, a downstream end 10*d* of the silencer 10 is positioned forward of a perpendicular line A extended from the axis of the axle shaft 72 of the rear wheel 70 in a vertical direction. In this manner, a conventional muffler, in which a downstream end of a silencer is positioned forwardly of an axle shaft of a rear wheel, involves a problem that the silencer is short in lengthwise dimension and a significant noise reducing effect due to pressure loss cannot be expected. While a damping characteristic can be improved to some extent by increasing an amount of a sound absorbing material as filled, a muffler is increased as a whole in weight corresponding to an increase amount of the sound absorbing material, so that the handling characteristics of the motorcycle are worsened.

In contrast, when the illustrated muffler is adopted, even the small-sized muffler as shown in FIG. 1 can meet the desired noise damping characteristics with little increase in weight of a whole muffler. Moreover, because it is unnecessary to increase an amount of a sound absorbing material (for example, glass wool) within the muffler, the manufacturing cost of the exhaust system can be reduced.

In addition, the downstream end 10*d* of the silencer 10 more specifically corresponds to a downstream end of the inner cylinder 10*b* provided in the silencer. Accordingly, even when a part of the tail pipe 30 connected to the silencer 10 is positioned rearward of the axle shaft 72 of the rear wheel 70, the structure corresponds to the small-sized muffler referred herein to. Also, the muffler structure is not limited to the muffler of the type shown in FIG. 1 but can be preferably used in a muffler of a so-called "cruiser" type motorcycle.

In addition, it is possible to use, as the sound absorbing material, for example, stainless steel wool, aluminum wool, ferrite, etc., in addition to glass wool. Since stainless steel wool is larger in specific gravity than other sound absorbing materials (for example, glass wool), an additional advantage is provided in that it becomes unnecessary to increase an amount of a sound absorbing material.

Also, while the punched holes 13 and the punched holes 11 in the embodiment are circular in shape, they are not limited thereto but can be otherwise shaped (for example, flat oval, elliptical, polygonal, etc.). Further, the punched holes 13 may be varied in diameter with locations of formation, or all the punched holes 13 as formed may be the same in diameter.

An internal construction of the silencer 10 according to the embodiment is described below with reference to FIGS. 4(*a*) and 4(*b*). FIGS. 4(*a*) and 4(*b*) are cross sectional views schematically showing a cross sectional structure of the silencer 10.

Shapes of respective members, which constitute the silencer 10 shown in FIG. 4, are illustrated as follows. The outer cylinder 10*a* in the embodiment is generally cylindrical and, more specifically, formed to be a flat oval in cross sectional shape. Also, the inner cylinder 10*b* and the partition 10*c* are generally cylindrical, and more specifically formed to be substantially circular in cross sectional shape. The punched holes 11 and the punched holes 13, respectively, are formed in the region P and the region Q. In addition, only a part of the punched holes (13 and 11) formed in the respective regions (P and Q) is shown in the figures for simplicity.

An explanation is provided below with respect to the effect that the sound absorbing material and the back air layer have on a damping characteristic of the exhaust system, in addition to comparative examples (FIG. 5) of two exhaust systems, along with a graph of a damping characteristic (FIG. 6) of the preferred embodiment and the two comparative examples.

FIG. 5(*a*) shows an internal construction of a silencer 10' as a comparative example 1 and FIG. 5(*b*) shows an internal construction of a silencer 10" as a comparative example 2. Also, FIG. 6 is a graph illustrating damping characteristics of the respective silencers of the embodiment and the comparative examples 1, 2.

Initially, a comparison is made between the preferred embodiment of FIG. 4 and the comparative example 1 (FIG. 5(*a*)). With the silencer 10, according to the embodiment shown in FIG. 4, the glass wool 15 is not fully filled between the outer cylinder 10*a* as described above and the inner cylinder 10*b* but arranged offset toward the inner cylinder 10*b* whereby the back air layer 19 is provided outside the glass wool 15. On the other hand, with the silencer 10' of the comparative example 1 shown in FIG. 5(*a*), a back air layer is not provided and, unlike the preferred embodiment, an outer cylinder 10*a'* is decreased in diameter whereby the glass wool 15 of approximately the same amount as that in the embodiment is fully filled within the silencer 10'.

FIG. 6 shows a comparison in damping characteristic between the both silencers. In FIG. 6, the X-axis or horizontal axis indicates frequency (Hz), the Y-axis or vertical axis indicates a damping level (dB) (also called a sound pressure level), and a small damping level in the same frequency means that a damping characteristic becomes favorable (that is, a noise value lowers). Line "L0" indicates a damping characteristic of the embodiment of FIG. 4 and Line "L1" indicates a damping characteristic of the comparative example 1.

When a comparison is made between Line "L0" and Line "L1", it is found that Line "L0" is wholly smaller in damping level (sound pressure level) than Line "L1". In other words, the silencer 10 according to the embodiment becomes low in noise value as compared with the silencer 10' of the comparative example 1. The reason why the embodiment is small in noise value as compared with the comparative example 1 is due to that construction, in which the back air layer 19 is provided outside the glass wool 15 within the silencer 10. That is, according to the embodiment, it has been confirmed that it is possible to improve a damping characteristic of the muffler owing to both effects of noise reduction by the glass wool 15 and noise reduction by an expansion chamber effect.

Subsequently, a comparison is made between the embodiment of FIG. 4 and the comparative example 2 of FIG. 5(*b*) to give an explanation to the effect that a ratio of a sound absorbing material and a back air layer has on a damping characteristic.

The silencers shown in the embodiment of FIG. 4 and the comparative example 2 of FIG. 5(*b*) are considerably different in the amount of glass wool from one another. That is, while glass wool is reduced in an amount of filling and the back air layer 19 is provided in the embodiment, the silencer 10" of the comparative example 2 does not include any back air layer according to a typical design technique and the glass wool 15 is fully filled between the outer cylinder 10*a* and the inner cylinder 10*b*.

FIG. 6 shows a comparison in damping characteristic between the both silencers. Line "L0" indicates a damping characteristic in the embodiment of FIG. 4 and Line "L2" indicates a damping characteristic in the comparative example 2. When a comparison is made between Line "L0" and Line "L2", peaks of respective frequencies of Line "L0" becomes larger in difference of elevation than those of "L2". That is, Line "L0" is one (that is, Line with modulation), in which respective peaks are large in difference of elevation, Line "L2" is one (that is, Line with less modulation), in which respective peaks are small in difference of elevation. Such difference in damping characteristic is due to a difference in ratio of a glass wool and a back air layer. That is, as the ratio of a glass wool increases, respective peaks in damping characteristic demonstrate a tendency of becoming dull, and as the ratio of a back air layer increases, respective peaks in damping characteristic becomes sharp. As a result, a phenomenon occurs in that Line "L0" and Line "L2" are reversed in elevation of damping level (sound pressure level) in a specified frequency range.

This phenomenon is made use of to enable selectively decreasing a damping level in a specified frequency range. For example, in the case where it is desired that a noise component in a frequency range "Fa (Hz) to Fb (Hz)" be selectively decreased, it suffices to increase an amount of glass wool as indicated by Line "L2" to decrease the ratio of a back air layer to a glass wool layer. On the other hand, in the case where it is desired that a noise component in a frequency range "Fc (Hz) to Fd (Hz)" be decreased, it suffices to decrease an amount of glass wool as indicated by Line "L0" to increase the ratio of a back air layer to a glass wool layer. In this manner, a damping characteristic in a desired frequency range can be made favorable by appropriately adjusting the ratio of a glass wool and a back air layer.

Further, a noise component in a desired frequency range can be decreased not only by the ratio of a glass wool and a back air layer but also a range (region Q) in which the punched holes 11 of the partition 10*c* are formed. A further embodiment (FIG. 7) and a damping characteristic graph (FIG. 8) are provided to give an explanation to effect that a region Q of punched holes 11 has on a damping characteristic.

FIG. 7(*a*) shows, as an example a, an arrangement in which a region Q of punched holes 11 extends between an upstream end of the partition 10*c* and a downstream end of the partition (similar to FIG. 4). Furthermore, the punched holes 11 extend in an upstream direction from an upstream end of the punched holes 13 of the inner cylinder 10*b*. FIG. 7(*b*) shows, as an example b, an arrangement in which a region Q of punched holes 11 extends only along a downstream end portion of the partition 10*c* and wherein the upstream end of the punched holes 11 begins downstream from an upstream end of the punched holes 13 of the inner cylinder 10*b*. In addition, the silencers of the example a and example b are different only in a structure of a region Q from the silencer 10. Accordingly, the same constituent members are denoted by the same reference numerals and a duplicate explanation therefore is omitted.

FIG. 8 shows a comparison in damping characteristic between the both silencers. Line "L0" indicates a damping characteristic in the embodiment of FIG. 4, Line "L3" indicates a damping characteristic in the embodiment of FIG. 7*a*, and Line "L4" indicates a damping characteristic in the embodiment of FIG. 7*b*. When a comparison is made among Line "L0", Line "L3", and Line "L4", a phenomenon occurs in that a damping level (sound pressure level) is reversed in a specified frequency range. Specifically, while a damping level (sound pressure level) decreases in the order (that is, in that order, in which a region Q widens) of Line "L4", Line "L0", and Line "L3" in a frequency range "Fe(Hz) to Ff (Hz)", a damping level decreases in a reverse order (that is, in that order, in which a region Q narrows) to the above order in a frequency range "Fg (Hz) to Fh (Hz)".

This phenomenon is made use of to enable selectively decreasing a noise component in a specific frequency range. That is, a damping characteristic in a desired frequency range can be made favorable by appropriately adjusting the range of the region Q of the punched holes 11. For example, in the case where it is desired that a noise component in a frequency range "Fg (Hz) to Fh (Hz)" be decreased, it suffices to widen the region Q like Line "L3" in the embodiment of FIG. 7*a*. In the case where it is desired that a noise component in a frequency range "Fe(Hz) to Ff (Hz)" be decreased, it suffices to narrow the region Q like Line "L4" in the embodiment of FIG. 7*b*. In this manner, a preferred region Q of the punched holes 11 can be selected in conformity to a demanded noise eliminating performance (a desired frequency range, in which it is desirable to decrease a damping level) of the muffler.

According to the invention, the silencer 10 comprises the outer cylinder 10*a* and the inner cylinder 10*b* accommodated in the outer cylinder 10*a* and the sound absorbing material 15 is arranged in a manner to come into close contact with the outer wall of the inner cylinder 10*b*, so that the sound absorbing material can absorb an exhaust noise of exhaust gases introduced into the silencer 10 whereby it is possible to reduce the exhaust noise. In addition, because the air layer 19 is provided between the outer surface of the sound absorbing material 15 and the inner surface of the outer cylinder, exhaust gases can be expanded into the air layer 19 whereby it is also possible to produce a noise reducing effect. That is, with the exhaust device according to preferred embodiments of the invention, it is possible to improve a damping characteristic of the muffler according to the embodiment owing to both effects of noise reduction by the sound absorbing material 15 and noise reduction by expansion (back air layer 19).

When the muffler structure according to the preferred embodiments is adopted, even a typical, small-sized muffler (muffler arranged forwardly of the axle shaft 72 of the rear wheel 70) can meet the damping characteristic with little increase in weight of a whole muffler.

In particular, in the case where stainless steel wool having a large specific gravity is used as the sound absorbing material 15, it is unnecessary to increase an amount of the stainless steel wool as filled, so that a further advantage is provided in that substantially the same damping characteristic is obtained with the same weight.

Also, in the case where an expensive glass wool is used as the sound absorbing material 15, it is unnecessary to increase an amount of the glass wool as filled, so that the manufacturing cost is lowered.

In addition, while FIG. 1 shows an off-road type motorcycle as an example of the motorcycle 1000, the motorcycle 1000 may be adapted for on-road use. Also, "motorcycle" in the specification of the present application means a motorcycle and means a vehicle, which includes a bicycle with a motor (motorbike) and a scooter that can specifically turn with a vehicle body inclined. Accordingly, a three-wheeler•four-wheeler, at least one of a front wheel and a rear wheel of which has two or more wheels and which is three, four (or more) in the number of tires, can be included in "motorcycle". In addition, applicability is not limited to a motorcycle but to other vehicles capable of making use of the effect of the invention, for example, a so-called straddle-type vehicle, which includes a four-wheeled buggy, ATV (All Terrain Vehicle), a snowmobile, and other similar vehicles in addition to motorcycles.

While the invention has been described with respect to preferred embodiments, such descriptions are not limitative but various modifications are of course possible. According to the invention, it is possible to provide a muffler for a straddle-type vehicle, which achieves miniaturization while meeting a demand for a noise reducing characteristic.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present exhaust system and vehicle employing the exhaust system have been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. An exhaust system for a vehicle, the exhaust system comprising:

an exhaust pipe connectable to an engine of the vehicle;

a silencer connected to the exhaust pipe, the silencer including an outer housing and an inner core accommodated in the outer housing, and a plurality of through-holes are provided along a length P of a side wall of the inner core;

a sound absorbing material arranged on an outer surface of the inner core;

an air space provided between an outer surface of the sound absorbing material and an inner surface of the outer housing;

a partition provided on the outer surface of the sound absorbing material to separate the sound absorbing material and the air space, wherein a plurality of through-holes are provided along a length Q of a side wall of the partition such that exhaust gases can pass from within the inner core to the air space through the plurality of through-holes of the inner core, the sound absorbing material, and the plurality of through-holes of the partition; and a tail pipe arranged to project from a downstream end of the silencer, the tail pipe having a smaller outer dimension than an inner dimension of the inner core, a portion of the tail pipe extending within the inner core; wherein the length Q of the partition including the plurality of through-holes is longer than the portion of the tail pipe extending within the inner core; and the length P of the side wall of the inner core is not equal to the length Q of the side wall of the partition; and the length P and the length Q extend to a same downstream point of the silencer.

2. The exhaust system of claim 1, wherein the sound absorbing material comprises stainless steel wool.

3. The exhaust system of claim 1, wherein the sound absorbing material comprises glass wool.

4. A straddle-type vehicle, comprising:

an engine having at least one combustion chamber;

an exhaust pipe connected to the engine and in communication with the at least one combustion chamber;

a silencer connected to the exhaust pipe, the silencer including an outer housing and an inner core accommodated in the outer housing, the inner core including a plurality of through-holes provided along a length P of a side wall of the inner core;

a sound absorbing material arranged on an outer surface of the inner core;

an air space provided between an outer surface of the sound absorbing material and an inner surface of the outer housing;

a partition provided on the outer surface of the sound absorbing material to separate the sound absorbing material and the air space, wherein a plurality of through-holes are provided along a length Q of a side wall of the partition; and a tail pipe arranged to project from a downstream end of the silencer, the tail pipe having a smaller outer dimension than an inner dimension of the inner core and a portion of the tail pipe extending within the inner core so that an annular space is defined between the tail pipe and the inner core; wherein the length Q of the partition including the plurality of through-holes is longer than the portion of the tail pipe extending within the inner core;

the length P of the side wall of the inner core is not equal to the length Q of the side wall of the partition; and the length P and the length Q extend to a same downstream point of the silencer.

5. The straddle-type vehicle of claim 4, wherein a downstream end of the silencer is positioned forward of an axis of an axle shaft of a rear wheel provided on the straddle-type vehicle.

6. The straddle-type vehicle of claim 4, wherein the engine operates on a four-stroke principle.

7. The straddle-type vehicle of claim 4, wherein the straddle-type vehicle is an off-road motorcycle.

8. The straddle-type vehicle of claim 4, wherein the sound absorbing material comprises stainless steel wool.

9. The straddle-type vehicle of claim 4, wherein the sound absorbing material comprises glass wool.

10. The straddle-type vehicle of claim 4, wherein the silencer is arranged such that exhaust gases can pass from within the inner core to the air space through the plurality of through-holes of the inner core, the sound absorbing material, and the plurality of through-holes of the partition.

11. An engine of a straddle-type vehicle including the exhaust system of claim 1.

12. An exhaust system for a vehicle, the exhaust system comprising:

an exhaust pipe connected to the engine and in communication with the at least one combustion chamber;

a silencer connected to the exhaust pipe, the silencer including an outer housing and an inner core accommodated in the outer housing, the inner core including a plurality of through-holes provided along a length P of a side wall of the inner core;

a sound absorbing material arranged on an outer surface of the inner core;

an air space provided between an outer surface of the sound absorbing material and an inner surface of the outer housing;

a partition provided on the outer surface of the sound absorbing material to separate the sound absorbing material and the air space, wherein a plurality of through-holes are provided along a length Q of a side wall of the partition; and a tail pipe arranged to project from a downstream end of the silencer, the tail pipe having a smaller outer dimension than an inner dimension of the inner core and a portion of the tail pipe extending within the inner core so that an annular space is defined between the tail pipe and the inner core; wherein the length Q of the partition including the plurality of through-holes is longer than the portion of the tail pipe extending within the inner core;

the length P of the side wall of the inner core is not equal to the length Q of the side wall of the partition; and the length P and the length Q extend to a same downstream point of the silencer.

13. The exhaust system of claim 12, wherein the sound absorbing material comprises stainless steel wool.

14. The exhaust system of claim 12, wherein the sound absorbing material comprises glass wool.

15. The exhaust system of claim 1, wherein the length P of the side wall of the inner core is longer than the length Q of the side wall of the partition.

16. The exhaust system of claim 1, wherein the length Q of the side wall of the partition is longer than the length P of the side wall of the inner core.

17. The straddle-type vehicle of claim 4, wherein the length P of the side wall of the inner core is longer than the length Q of the side wall of the partition.

18. The straddle-type vehicle of claim 4, wherein the length Q of the side wall of the partition is longer than the length P of the side wall of the inner core.

19. The exhaust system of claim 12, wherein the length P of the side wall of the inner core is longer than the length Q of the side wall of the partition.

20. The exhaust system of claim 12, wherein the length Q of the side wall of the partition is longer than the length P of the side wall of the inner core.

* * * * *